US006387293B1

(12) United States Patent
Akioka et al.

(10) Patent No.: US 6,387,293 B1
(45) Date of Patent: May 14, 2002

(54) COMPOSITION FOR RARE EARTH BONDED MAGNET USE, RARE EARTH BONDED MAGNET AND METHOD FOR MANUFACTURING RARE EARTH BONDED MAGNET

(75) Inventors: Koji Akioka, Matsamoti; Yoshiki Nakamura, Yamagata-mura; Ken Ikuma, Suwa, all of (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 09/508,905

(22) PCT Filed: Jul. 16, 1999

(86) PCT No.: PCT/JP99/03870

§ 371 Date: Mar. 16, 2000

§ 102(e) Date: Mar. 16, 2000

(87) PCT Pub. No.: WO00/05732

PCT Pub. Date: Feb. 3, 2000

(30) Foreign Application Priority Data

Jul. 21, 1998 (JP) ..... 10-205647

(51) Int. Cl.[7] ..... H01F 1/08

(52) U.S. Cl. ..... 252/62.54; 252/62.55; 264/612

(58) Field of Search ..... 264/612; 252/62.54, 252/62.55

(56) References Cited

U.S. PATENT DOCUMENTS

| | | | | |
|---|---|---|---|---|
| 5,767,426 A | * | 6/1998 | Oliver et al. | 252/62.53 |
| 5,932,134 A | * | 8/1999 | Christ et al. | 252/62.54 |
| 6,143,193 A | * | 11/2000 | Akioka et al. | 252/62.55 |

FOREIGN PATENT DOCUMENTS

| | | | |
|---|---|---|---|
| EP | 0285990 | | 3/1988 |
| JP | 05304010 | | 11/1993 |
| JP | 6-168810 | | 6/1994 |
| JP | 6-236806 | | 8/1994 |
| JP | 6-290922 | | 10/1994 |
| JP | 6-316745 | | 11/1994 |
| JP | 7-37741 | | 2/1995 |
| JP | 7-130523 A | * | 5/1995 |
| JP | 7-130523 | | 5/1995 |
| JP | 9-22828 | | 1/1997 |
| JP | 9-97732 | | 4/1997 |
| JP | 9-190909 | | 7/1997 |
| JP | 10-41116 | | 2/1998 |
| JP | 11-67514 | | 3/1999 |

OTHER PUBLICATIONS

C. Tattam, A.J. Williams, J.N. Hay, and I.R. Harris, S.F. Tedstone and M.M. Ashraf, "The use of polytetrafluoroesthylene in the production of high–density bonded Nd–Fe–B magnets" 931 Journal of Applied Physics 76 (1994) Nov. 15, Part 2, No. 10, Woodbury, NY US.

* cited by examiner

*Primary Examiner*—C. Melissa Koslow
(74) *Attorney, Agent, or Firm*—Harness, Dickey & Pierce, P.L.C.

(57) ABSTRACT

A composition for a rare earth bonded magnet, the rare earth bonded magnet and the method for manufacturing the rare earth bonded magnet are provided that produce little decline in mechanical strength caused by the addition of a lubricant and have excellent molding properties. The rare earth bonded magnet of the present invention is manufactured from the composition for the magnet that contains rare earth magnetic powder, binding resin containing thermoplastic resin, and fluorine-based resin powder, by compaction molding, extrusion molding or injection molding. The fluorine-based resin powder has the properties of improving mainly lubrication between a molding and a metallic mold. The content of the fluorine-based resin powder in the composition for the rare earth bonded magnet is preferably less than 20 vol % relative to the thermoplastic resin, and the particle diameter of the fluorine-based resin powder is preferably 2–30 $\mu$m.

26 Claims, No Drawings

COMPOSITION FOR RARE EARTH BONDED MAGNET USE, RARE EARTH BONDED MAGNET AND METHOD FOR MANUFACTURING RARE EARTH BONDED MAGNET

TECHNICAL FILED

This invention relates to a composition for a rare earth bonded magnet, the rare earth bonded magnet and a method for manufacturing the rare earth bonded magnet.

BACKGROUND ART

A rare earth bonded magnet is manufactured by using a compound of rare earth bonded magnetic powder and binding resin (organic binder), and by molding it with pressure into a preferable magnet shape. For the molding method, a compaction molding method, an injection molding method and an extrusion molding method are used.

The compaction molding method is a method where a molding is provided by filling a press metallic mold with the compound and by compacting it with pressure, and a magnet is then manufactured by curing thermosetting resin—a binding resin—with heat. Since this method can mold even with less binding resin than other methods, the quantity of resin in a magnet is reduced and the method can improve magnetic properties.

The extrusion molding method is a method where the heated and melted compound is pushed out of a metallic mold of an extrusion-molding machine and is, at the same time, cooled and solidified and then cut into a preferable length to provide a magnet. This method has advantages in that the shapes of magnets are flexible and a light and long magnet can easily be manufactured. However, in order to maintain the fluidity of the melted compound during the molding process, this method needs more binding resin than the compaction molding method, so that there are disadvantages in that the quantity of resin in a magnet will be large and magnetic properties will decline.

The injection molding method is a method where the compound is heated and melted, and the melted material is injected into a metallic mold with sufficient fluidity and is molded into a predetermined magnet shape. This method has more flexibility in shaping magnets than the extrusion molding method, and particularly has an advantage in that magnets of different shapes can also be easily manufactured. However, the method requires higher fluidity for the melted material during the molding process than the extrusion molding method, so that the method needs more binding resin than the extrusion molding method; thus, there are disadvantages in that the quantity of resin in a magnet is large and magnetic properties decline.

When a rare earth bonded magnet is molded in each above-noted molding method, silicone oil and various waxes, metallic soap such as fatty acid zinc and zinc stearate, calcium stearate, etc., or the like are usually added as a lubricant so as to improve molding properties. However, the addition of such a lubricant generates the following inconveniences, depending on the composition and the added quantity.

For instance, when a metallic soap is added, there is a problem in that the mechanical strength of a molding will be less than that of one with no added soap. Also, as a liquid lubricant such as silicone oil is added in a large quantity, particles or the like stick to the surface of a molded magnet in secondary processing such as grinding and trimming, and it is difficult to remove them. Moreover, these deposits result in the deterioration of corrosion resistance of a magnet. Furthermore, due to the generation of "discharge", coating the surface of a magnet will be difficult.

In order to avoid the above-noted problems, the quantity of a lubricant is kept at a minimum level, but in this case, the improvement of molding properties is sometimes not achieved by such a level. The object of the present invention is to provide a rare earth bonded magnet, a composition for the rare earth bonded magnet, and a method for manufacturing the rare earth bonded magnet that solves the conventional problems such as reduction of mechanical strength by adding fluorine-based resin powder and has excellent molding properties due to lubrication.

DISCLOSURE OF THE INVENTION (1) A first invention is a composition for a rare earth bonded magnet comprising rare earth magnetic powder and binding resin containing thermoplastic resin; wherein the composition comprises fluorine-based resin powder.

(2) A second invention is a composition for a rare earth bonded magnet provided by kneading the mixture of rare earth magnetic powder, binding resin containing thermoplastic resin and a lubricant; wherein fluorine-based resin powder is contained as the lubricant.

(3) It is preferable that the content of the fluorine-based resin powder is less than 20 vol % relative to the thermoplastic resin.

(4) It is also preferable that the average particle diameter of the fluorine-based resin powder is 2–30 $\mu$m(micro-meter).

(5) It is further preferable that the composition for the rare earth bonded magnet contains an antioxidant.

(6) It is preferable that the content of the antioxidant in the composition for the rare earth bonded magnet is 2–12 vol %.

(7) A third invention is a bonded magnet provided by bonding rare earth magnetic powder with binding resin containing thermoplastic resin; wherein the magnet contains fluorine-based resin powder.

(8) It is preferable that the content of the fluorine-based resin powder is less than 20 vol % relative to the thermoplastic resin.

(9) It is also preferable that the fluorine-based resin powder comprises at least one resin selected from the group consisting of tetrafluoroethylene (PTFE), tetrafluoroethylene-perfluoroalkoxyethylene copolymer (PFA), tetrafluoroethylene-propylene hexafluoride copolymer (FEP), tetrafluoroethylene-propylene hexafluoride-perfluoroalkoxyethylene copolymer (EPE), tetrafluoroethylene-ethylene copolymer (ETFE), ethylene chloride trifluoride copolymer (PCTFE), ethylene chloride trifluoride-ethylene copolymer (ECTFE), vinylidene fluoride (PVDF), and polyvinyl fluoride (PVE).

(10) It is preferable that the rare earth bonded magnet is molded by an injection molding method, and that the content of the rare earth magnetic powder is 68–76 vol %.

(11) It is also preferable that the rare earth bonded magnet is molded by an extrusion molding method, and that the content of the rare earth magnetic powder is 78.1–83 vol %.

(12) It is further preferable that the rare earth bonded magnet is molded by a compaction molding method, and that the content of the rare earth magnetic powder is 78–86 vol %.

(13) It is preferable that the compaction molding method is a warm molding method whereby pressing and molding are carried out above the thermal deformation temperature of the thermoplastic resin.

(14) It is also preferable that the rare earth magnetic powder essentially comprises rare earth elements mainly containing Sm and transition metals mainly containing Co.

(15) It is further preferable that the rare earth magnetic powder essentially comprises R (wherein R is at least one rare earth element among rare earth elements containing Y), transition metals mainly containing Fe, and B.

(16) It is preferable that the rare earth magnetic powder essentially comprises rare earth elements mainly containing Sm, transition metals mainly containing Fe, and interstitial elements mainly containing N.

(17) It is also preferable that the rare earth magnetic powder is the mixture of at least two types of the rare earth magnetic powder mentioned in either (14) or (16) above.

(18) It is preferable that the product of isotropic magnetic energy ($(BH)_{max}$) is more than 4.5 MGOe in the rare earth bonded magnet.

(19) It is also preferable that the product of anisotropic magnetic energy ($(BH)_{max}$) is more than 10 MGOe in the rare earth bonded magnet.

(20) It is preferable that a void ratio is below 2 vol % in the rare earth bonded magnet.

(21) A fourth invention comprises the steps of preparing a composition for a rare earth bonded magnet containing rare earth magnetic powder, binding resin including thermoplastic resin, and fluorine-based resin powder; and of molding the composition for a rare earth bonded magnet into a preferable shape.

(22) It is preferable that the step of preparing a composition for a rare earth bonded magnet includes the kneading process above the softening temperature of the binding resin.

(23) It is also preferable that the composition for a rare earth bonded magnet contains the fluorine-based resin powder at less than 20 vol % relative to the thermoplastic resin.

(24) It is preferable that the average particle diameter of the fluorine-based resin powder is 2–30 $\mu$m.

(25) It is also preferable that the composition for a rare earth bonded magnet contains an antioxidant.

(26) It is further preferable that the content of the antioxidant in the composition for the rare earth bonded magnet is 2–12 vol %.

(27) It is preferable that the molding step is due to an injection molding method.

(28) It is also preferable that the molding step is due to an extrusion molding method.

(29) It is further preferable that the molding step is due to a compaction molding method.

(30) It is preferable that the compaction molding method is a warm molding method whereby pressing and molding are carried out above the thermal deformation temperature of the thermoplastic resin.

BEST MODE FOR CARRYING OUT THE INVENTION

The composition for a rare earth bonded magnet, the rare earth bonded magnet, and the method for manufacturing the rare earth bonded magnet of the present invention will be explained.

Rare Earth Bonded Magnet

First, the rare earth bonded magnet of the present invention will be explained.

The rare earth bonded magnet of the present invention contains the following rare earth magnetic powder, thermoplastic resin and fluorine-based resin powder as a lubricant, and, if necessary, an antioxidant and other additives are also contained.

1. Rare Earth Magnetic Powder

As rare earth magnetic powder, an alloy of rare earth elements and transition metals is preferable, and particularly, the following [1]–[5] are further preferable.

[1] An alloy that essentially includes rare earth elements mainly containing Sm and transition metals mainly containing Co (mentioned as Sm—Co-based alloy hereinafter);

[2] An alloy that essentially includes R (wherein R is at least one rare earth element containing Y), transition metals mainly containing Fe, and B (mentioned as R—Fe—B-based alloy hereinafter);

[3] An alloy that essentially includes rare earth elements mainly containing Sm, transition metal mainly containing Fe, and interstitial elements mainly containing N (mentioned as Sm—Fe—N-based alloy hereinafter);

[4] An alloy that essentially includes R (wherein R is at least one rare earth element containing Y) and transition metals such as Fe, and has a magnetic phase at a nanometer level (mentioned as nanocrystal magnet hereinafter); and

[5] An alloy that is the mixture of at least two types of the above-noted compositions [1]–[4]. In this case, with the advantages of each magnetic powder for the mixture, magnetic properties will be easily enhanced.

$SmCO_5$ and $Sm_2TM_{17}$ (wherein TM is a transition metal) are typical Sm—Co-based alloys.

Nd—Fe—B-based alloy, Pr—Fe—B-based alloy, Nd—Pr—Fe—B-based alloy, Ce—Nd—Fe—B-based alloy, Ce—Pr—Nd—Fe—B-based alloy and the alloys thereof wherein a portion of Fe is replaced with other transition metals such as Co and Ni are typical R—Fe—B-based alloys.

$Sm_2TM_{17}N_3$ where $Sm_2TM_{17}$ alloy is nitrided is a typical Sm—Fe—N-based alloy.

Rare earth elements in the magnetic powder are Y, La, Ce, Pr, Nd, Pm, Sm, Eu, Ge, Th, Dy, Ho, Er, Tm, Yb, Lu and misch metals, and one or two types thereof may be contained.

Fe, Co, Ni, etc. are the transition metals, and one or two types thereof may be contained. Moreover, in order to improve magnetic properties, B, Al, Mo, Cu, Ga, Si, Ti, Ta, Zr, Hf, Ag, Zn, etc. may be contained in the magnetic powder, if necessary.

The methods of manufacturing magnetic powder are not particularly limited. The powder may be prepared by any method, for example, of preparing an alloy ingot by dissolving and casting and then milling this alloy ingot into an appropriate particle diameter (and, furthermore, sorting), and of manufacturing a melt spun ribbon (aggregation of fine polycrystals) by the Melt Spinning Apparatus used for manufacturing amorphous alloys and then milling this thin piece (thin ribbon) into an appropriate particle diameter (and, furthermore, sorting).

The average particle diameter of the magnetic powder is not particularly limited, but is preferably about 0.5–50 $\mu$m, more preferably around 1–30 $\mu$m, and further preferably about 2–28 $\mu$m.

The particle diameter distribution of the above-noted magnetic powder may be even or may be dispersed to some extent; but in molding with a small amount of binding resin as described later, the particle diameter distribution of the magnetic powder is preferably dispersed (uneven) to some degree to obtain preferable molding properties. As a result, the void ratio of the bonded magnet may be further reduced.

Moreover, in case of [5] mentioned above, the average particle diameter may be different per magnetic powder composition for mixture. Thus, as the one is used where two or more types of magnetic powder having different average particle diameters are mixed, the probability that magnetic powder with a small particle diameter will enter into magnetic powder with a large particle diameter by kneading will become high. Thus, the filling factor of magnetic powder in the compound can improve, achieving higher magnetic properties of a bonded magnet.

A suitable content of such magnetic powder in a magnet is determined in a preferable range for the molding method of the magnet.

In other words, in the case of the rare earth bonded magnet manufactured by compaction molding, the content of the rare earth magnetic powder is about 78–86 vol %, or more preferably 80–86 vol %.

Also, in the case of the rare earth bonded magnet manufactured by extrusion molding, the content of the rare earth magnetic powder is about 78.1–83 vol %, or more preferably 80–83 vol %.

Furthermore, in the case of the rare earth bonded magnet being manufactured by injection molding, the content of the rare earth magnetic powder is about 68–76 vol %, or more preferably 70–76 vol %.

If the content of the magnetic powder is too little in each molding method, magnetic properties (particularly, the product of magnetic energy) will not improve. On the other hand, if the content of the magnetic powder is too high, the content of binding resin will be relatively small, so that the fluidity of the compound during molding will decrease and the molding will become difficult or impossible.

2. Binding Resin (Binder)

Thermoplastic resin (binding resin powder) is applied as binding resin (binder).

The thermoplastic resin applicable to the present invention includes, for instance, polyamide (e.g., nylon 6, nylon 46, nylon 66, nylon 610, nylon 612, nylon 11, nylon 12, nylon 6-12, nylon 6-66), thermoplastic polyimide, liquid crystal polymer such as aromatic polyester, polyolefin such as polyphenylene oxide, polyphenylene sulfide, polyethylene and polypropylene, denaturated polyolefin, polycarbonate, polymethyl methacrylate, polyether, polyether etherketone, polyether imide, polyacetal, etc., or the copolymers, blended resins, polymer alloys, etc. containing these as a main component; and one or more than two types thereof may be mixed for the application.

Among these, polyamide is particularly preferable since the improvement in molding properties is quite obvious and mechanical strength is high. Also, for the improvement of heat-resistance, the one containing liquid crystal polymer and polyolefin sulfide as main components is preferable. These thermoplastic resins have excellent kneading properties with magnetic powder.

The thermoplastic resin preferably has a melting point of 400° C. or below, or more preferably 300° C. or below. When the melting point exceeds 400° C., molding temperature increases and magnetic powder, etc. is likely to be oxidized.

Also, the average molecular weight (polymerization degree) of the thermoplastic resin used for further increasing molding properties is preferably about 10,000–60,000, or more preferably about 12,000–30,000.

The ratios of the binding resin powder in a rare earth bonded magnet as mentioned above are not particularly limited; but the total amount with an additive such as the antioxidant mentioned later is preferably around 14–32 vol %, more preferably about 14–30 vol %, or further preferably around 14–28 vol %. If the content of the binding resin powder is too high, magnetic properties (particularly, the product of magnetic energy) will not improve. Also, if the content of the binding resin powder is too little, molding properties will decline and molding will be difficult or impossible in an extreme case.

3. Fluorine-based Resin Powder

The rare earth bonded magnet of the present invention has fluorine-based resin powder.

Fluorine-based resin has a high melting point (320° C. or above) and does not melt even during the kneading process of the composition for a rare earth bonded magnet and during the magnet molding process, so the resin functions as a lubricant and reduces the abrasion factor between a metallic mold and a molding, thus improving sliding properties between the metallic mold and the molding.

For instance, when a molding is taken out from a metallic mold in compaction molding, abrasion of sliding surfaces between the molding and the metallic mold is reduced, so that mold release will become easy. Also, in the case of extrusion molding, abrasion between the metallic mold of an extrusion device and a molding is reduced, so that extrusion speed can increase and productivity will increase. Similarly, even in case of injection molding, sliding properties between a molding and a metallic mold increase, so that e.g., the pressure of an injector bin may be kept small and mold release will be easy.

Such fluorine-based resin is, for instance, at least one kind selected from the group consisting of tetrafluoroethylene (PTFE), tetrafluoroethylene-perfluoroalkoxyethylene copolymer (PFA), tetrafluoroethylene-propylene hexafluoride copolymer (FEP), tetrafluoroethylene-propylene hexafluoride-perfluoroalkoxyethylene copolymer (EPE), tetrafluoroethylene-ethylene copolymer (ETFE), ethylene chloride trifluoride copolymer (PCTFE), ethylene chloride trifluoride-ethylene copolymer ECTFE), vinylidene fluoride (PVDF), and polyvinyl fluoride (PVE); however, accessible tetrafluoroethylene (PTFE) is particularly preferable and one or more than two kinds thereof may be mixed for application.

The content of fluorine-based resin powder in a rare earth bonded magnet is preferably less than 20 vol %, or more preferably about 1–15 vol %, relative to the above-noted thermoplastic resin.

If the content of the fluorine-based resin powder is too high, the magnetic properties and mechanical properties of a magnet will decrease. On the other hand, when the content is too little, for example, effects as the above-noted lubricant will not be sufficient.

Also, the particle diameter of fluorine-based resin powder is not particularly limited, but is preferably around 2–30 $\mu$m. If the particle diameter is too small, it will be difficult to disperse the particles in a compound, so that e.g., the above-noted lubricating operations will be incomplete and the effects of molding properties will not improve. On the other hand, as the particle diameter becomes too large, it will be about as large as magnetic powder and there will be a need to increase the quantity added so as to obtain sufficient lubricating effects; and it is not preferable if the mechanical strength of a magnet will decrease by increasing the content.

Also, the particle diameter of fluorine-based resin powder may be dispersed to some extent even if it is evenly distributed; however, in order to obtain preferable molding properties during molding, the particle diameter distribution of fluorine-based resin powder is preferably dispersed (uneven) to some extent. As a result the void ratio of the bonded magnet may be further reduced.

Furthermore, the rare earth bonded magnet of the present invention may additionally contain other lubricants or plasticizers. These include various inorganic lubricants, for instance, silicone oil, various waxes, fatty acid (for example, oleic acid), alumina, silica, titania, etc. More preferable lubricating effects are obtained by adding at least one type of these, and the fluidity of a material during molding will further improve. Particularly, the supplementary addition of liquid lubricant such as silicone oil and fatty acid improves the wettability of fluorine-based resin powder and dispersion in a compound.

4. Antioxidant

The rare earth bonded magnet of the present invention preferably contains an antioxidant.

The antioxidant prevents the oxidation (deterioration, alteration) of rare earth magnetic powder and the oxidation of binding resin (probably caused by the metal component of the rare earth magnetic powder as a catalyst) during the kneading process of the composition for the rare earth bonded magnet mentioned later.

This antioxidant sometimes volatilizes or is altered in the intermediate process such as the kneading or molding process of the composition for a rare earth bonded magnet, so that a portion of the antioxidant remains in the rare earth bonded magnet as a residual. Thus, the content (residual amount) of the antioxidant in a rare earth bonded magnet is about 10–95%, or more preferably around 20–91%, relative to the added amount in the composition for the rare earth bonded magnet mentioned later.

In the magnet of the present invention, the void ratio is preferably less than 2 vol %, or more preferably 1.8 vol %. When the void ratio is too high, the mechanical strength and magnetic properties of the magnet may decrease, depending on other conditions such as the composition of magnetic powder and binding resin, and contents.

When the rare earth bonded magnet of the present invention is isotropic, the product of magnetic energy ($(BH)_{max}$) is preferably more than 4.5 MGOe, or more preferably more than 6 MGOe. Also, when the magnet is anisotropic, the product of magnetic energy ($(BH)_{max}$) is preferably more than 10 MGOe, or more preferably greater than 12 MGOe.

Moreover, the shapes and sizes of the rare earth bonded magnet of the present invention are not particularly limited: for example, various shapes such as a column, prism, cylinder, circle, plate, curved plate shape, etc. are applicable, and the sizes are various including large to extra-small.

Composition for Rare Earth Bonded Magnet

The composition for a rare earth bonded magnet will next be explained.

The composition for a rare earth bonded magnet of the present invention is the mixture of the above-described rare earth magnetic powder, the thermoplastic resin mentioned above, the above-noted fluorine-based resin powder and, if necessary, an additive such as the antioxidant described above, or the composition is prepared by kneading the mixture.

1. Rare Earth Magnetic Powder

The added amount of rare earth magnetic powder in the composition for a rare earth bonded magnet is determined in consideration of the magnetic properties of the rare earth bonded magnet and the fluidity of the melted composition during molding.

In other words, in case of the composition for a rare earth bonded magnet for compaction molding, the content (added amount) of the rare earth magnetic powder in the composition is not particularly limited, but is preferably 78–86 vol %, or more preferably 80–86 vol %.

Moreover, in the case of the composition for a rare earth bonded magnet for extrusion molding, the content (added amount) of the rare earth magnetic powder in the composition is not particularly limited, but is preferably 78.1–83 vol %, or more preferably 80.5–83 vol %.

Furthermore, in the case of the composition for a rare earth bonded magnet for injection molding, the content (added amount) of the rare earth magnetic powder in the composition is not particularly limited, but is preferably 68–76 vol %, or more preferably 70–76 vol %.

In each molding method, magnetic properties (particularly, the product of magnetic energy) will not improve if there is too little magnetic powder; on the other hand, when there is too much magnetic powder, the content of binding resin will be relatively small and molding will thus become difficult or impossible.

2. Binding Resin

The content of binding resin powder in the composition for a rare earth bonded magnet is not particularly limited, but the total amount with an additive such as the above-noted antioxidant is preferably around 14–32 vol %, more preferably about 14–30 vol %, or even more preferably around 14–29 vol %. If the content of binding resin powder is too high, magnetic properties (particularly, the magnetic energy product) will not improve. Also, when the content of binding resin powder is too little, the fluidity of the composition will decrease and molding will be difficult or impossible in an extreme case.

3. Fluorine-based Resin Powder

In the composition for a rare earth bonded magnet, the content (added amount) of the above-mentioned fluorine-based resin powder is not particularly limited, but is preferably less than 20 vol %, or more preferably about 1–15 vol %, relative to the thermoplastic resin mentioned above. When the added amount of fluorine-based resin powder is too high, the magnetic properties and mechanical properties of a magnet will decline: when the content is too little, e.g., lubricating effects will not be sufficient.

4. Antioxidant

The composition for a rare earth bonded magnet of the present invention preferably contains an antioxidant.

The antioxidant, as described above, prevents the oxidation (deterioration, alteration) of rare earth magnetic powder and the oxidation of binding resin (probably caused by the metal component of the rare earth magnetic powder as a catalyst) during the kneading process of the composition for a rare earth bonded magnet.

The addition of this antioxidant provides the following effects.

First, since it prevents the oxidation of rare earth magnetic powder and binding resin and maintains preferable wettability of binding resin to the surface of rare earth magnetic powder, the kneading properties of magnetic powder and binding resin increase.

Secondly, it prevents the oxidation of rare earth magnetic powder and improves the magnetic properties of a magnet and, at the same time, improves thermal stability during the kneading and molding process of the composition for a rare earth bonded magnet and can maintain preferable molding properties even with a small amount of binding resin.

For an antioxidant, anything is applicable as long as it can prevent or limit the oxidation of rare earth magnetic powder, etc. For instance, amine compounds, amino acid compounds, nitrocarboxylic acids, hydrazine compounds, cyanogen compounds, and chelating agents for deactivating the surface of magnetic powder such as sulfide are preferably applied. In addition, it goes without saying that the types and compositions, etc. of antioxidants are not limited to these.

The added amount of an antioxidant in the composition for a rare earth bonded magnet is not particularly limited, but is preferably around 1–12 vol %, or more preferably about 2–10 vol %.

If the added amount of an antioxidant or the like is too little, sufficient oxidation inhibiting effects cannot be obtained. On the other hand, when the added amount is too great, the amount of resin will decrease relatively and the mechanical strength of a molding will decline.

Also, the added amount of an antioxidant may be less than the lower limit of the above-noted range in the present invention, or may be none.

5. Other Additives

The composition for a rare earth bonded magnet of the present invention may contain other various additives if necessary. For instance, the addition of the above-noted lubricant is preferable since it improves fluidity during molding and can provide the same properties with less binding resin. The added amount of this lubricant is not particularly limited, but is preferably about 1–5 vol %, or more preferably about 1–3 vol %. As the added amount is within this range, lubricating properties can be effectively obtained without deteriorating the properties of a magnet.

The mixing and preparation of the composition for a rare earth bonded magnet are carried out by, for instance, a mixer such as a V-type mixer and an agitator. Also, the mixture is kneaded by e.g., a twin screw extruder, a roll mill, and a mill such as a kneader.

Moreover, it is preferable that the mixture is kneaded above the softening temperature (softening point or glass transition point) of the binding resin. As a result, kneading will become more efficient, and the mixture can be kneaded evenly in a shorter period than kneading at ordinary temperature. Moreover, since the mixture is kneaded with less binding resin viscosity, rare earth magnetic powder will be coated with the binding resin, thus reducing the void ratio in the composition for a rare earth bonded magnet and in the magnet manufactured thereby.

Furthermore, since the kneading temperature is likely to change from kneading due to the heating of materials themselves, it is preferable to knead by a mill that has heating and cooling means and can control temperature.

Moreover, the density of the composition for a rare earth bonded magnet (in case of a kneaded material) is preferably greater than 80% of the theoretical density (density when the void in the composition is 0), or more preferably greater than 85%. Also, the density of the composition for a rare earth bonded magnet (in case of a kneaded material) is preferably more than 60% of the density of rare earth magnetic powder, or more preferably greater than 70%. When the density of the composition for a rare earth bonded magnet is within such a range, molding pressure can be further lowered.

Furthermore, the composition for a rare earth bonded magnet of the present invention may be a further pelletized one (for example, about 1–12 mm in particle diameter), etc. When such a kneaded material or the pellets thereof are applied, the molding properties of compaction molding, extrusion molding and injection molding further improve. Moreover, it will be easier to handle if the pellets are applied.

Method for Manufacturing a Rare Earth Bonded Magnet

The method for manufacturing a rare earth bonded magnet of the present invention molds a composition for a rare earth bonded magnet that contains rare earth magnetic powder, binding resin including thermoplastic resin and fluorine-based resin powder into a preferable shape.

The composition for a rare earth bonded magnet is prepared as described above, and the composition is molded into a magnet shape by e.g., a compaction molding method, an extrusion molding method or an injection molding method.

Each molding method will be explained below.

[1] Compaction Molding Method

The above-mentioned composition for a rare earth bonded magnet (compound) is manufactured, and this composition fills in a metallic mold of a compaction molding machine and is then compacted and molded under a magnetic field (e.g., 5–20 kOe in alignment field: vertical, horizontal and radial alignment directions) or a non-magnetic field.

This compaction molding is preferably a warm molding method. In other words, it is preferable to add pressure and mold above the thermal deformation temperature of the thermoplastic resin.

By such warm molding, the fluidity of a molding material in a metallic mold improves, and molding with excellent size precision is carried out at a low molding pressure. In other words, molding can be carried out at the molding pressure preferably below 50 kgf/mm$^2$, more preferably below 30 kgf/mm$^2$, or more preferably below 10 kgf/mm$^2$. The load to molding is small; molding will be easy, and at the same time, magnets with a thin wall thickness in a ring, plate or curved plate shape, etc. or long ones may be mass-produced at a preferable and stable shape and size.

Also, since it is warm molding, the void ratio of the produced magnet will be lowered even at the above-mentioned low molding pressure.

Moreover, since it is warm molding, the fluidity of a molding material in a metallic mold will increase and magnetic alignment will improve. At the same time, due to the decline in coercion force of rare earth magnetic powder during molding, an apparently high magnetic field is added in the case of molding under a magnetic field, so that magnetic properties may be enhanced without depending on alignment orientations.

After compacting and molding as mentioned above, the material is removed from the molding metallic mold, and the rare earth bonded magnet is then obtained.

[2] Extrusion Molding Method

A composition for a rare earth bonded magnet (mixture) containing rare earth magnetic powder, thermoplastic resin, fluorine-based resin powder as a lubricant and, if necessary, an antioxidant is thoroughly kneaded by the above-noted mill so as to prepare a kneaded material. In this case, kneading temperature is determined in consideration of the above-noted conditions (such as the softening temperature of binding resin, etc.), and is about e.g., 150–350° C. In addition, the kneaded material may be applied as pellets.

The mixture (compound) of the composition for a rare earth bonded magnet obtained as mentioned above is heated and melted above the melting temperature of thermoplastic resin in a cylinder of an extrusion molding machine, and this melted material is pushed out from a die of the extrusion molding machine under a magnetic field or non-magnetic field (e.g., 10–20 kOe in alignment magnetic field).

A molding is cooled while it is pushed out of e.g., the die, and is then solidified. Then, the long pushed-out molding is cut appropriately, thus providing a rare earth bonded magnet of a preferable shape and size.

The horizontal cross-sectional shape of a rare earth bonded magnet is determined by the selection of die (inner die and outer die) shapes of the extrusion molding machine, and the ones with a thin wall thickness or with different cross sections can be easily manufactured. Also, long magnets can be manufactured by an adjustment of the cut length of the molding.

By the method mentioned above, the shapes of magnets are variable, and rare earth bonded magnets that have excellent fluidity, molding properties and excellent size precision are capable of continuous manufacture and are suitable for mass-production.

[3] Injection Molding Method

A composition for a rare earth magnet is kneaded as in the above-mentioned extrusion molding method.

Then, this kneaded material (compound) is heated and melted above the melting temperature of thermoplastic resin in an injection cylinder of an injection molding machine, and this melted material is then injected into a metallic mold of the injection molding machine under a magnetic field or non-magnetic field (e.g., 10–20 kOe in alignment magnetic field). At this time, the temperature inside the injection cylinder is preferably about 220–350° C.; the injection pressure is preferably around 30–120 kgf/cm$^2$; and the metallic mold temperature is preferably about 70–110° C.

Then, the molding is cooled and solidified, and a rare earth bonded magnet of a preferable shape and size is then obtained. At this time, the cooling period is preferably about 5–30 seconds.

The shapes of a rare earth bonded magnet depend on the shapes of a metallic mold of the injection molding machine; and types with a thin wall thickness and different shapes may be easily manufactured by the selection of cavities of this metallic mold.

The above-mentioned method has more flexibility in magnet shapes than extrusion molding; the method has excellent fluidity, molding properties and size precision even with little resin; the molding cycle is short; and a rare earth bonded magnet suitable for mass-production can be manufactured.

Also, in the method for manufacturing the rare earth bonded magnet of the present invention, it goes without saying that kneading conditions, molding conditions, etc. are not limited to the above-described ranges.

EMBODIMENTS

An explanation is provided below with respect to concrete embodiments of the present invention.

Embodiments 1–17; Comparative Examples 1–4

Preparations are made of rare earth magnetic powders of the following seven compositions of rare earth magnetic powder [1], [2], [3], [4], [5], [6], and [7]; the following three types of binding resin powder—A, B, C—made from thermoplastic resin; the following fluorine-based resin powder a and b; the following lubricants a and b; hydrazine-contained antioxidants; and oleic acid as an auxiliary lubricant. These are mixed in the prescribed amounts and assortments shown in Table 1. In addition, the average particle diameter of the fluorine-based resin powder of each embodiment is shown in Table 2.

Furthermore, the average particle diameter of lubricants of the powder form, of fluorine-based resin powder, and of magnetic powder are measured according to the F.S.S.S. (Fischer Sub-Sieve Sizer) method.

Magnetic Rare Earth Magnetic Powder

[1] Quenched $Nd_{12}Fe_{78}Co_4B_6$ powder (average particle diameter=18 $\mu$m)

[2] Quenched $Nd_8Pr_4Fe_{82}B_6$ powder ( average particle diameter=17 $\mu$m)

[3] Quenched $Nd_{12}Fe_{82}B_6$ powder (average particle diameter=19 $\mu$m)

[4] $Sm(Co_{0.604}Cu_{0.06}Fe_{0.82}Zr_{0.016})_{8.0}$ powder (average particle diameter=21 $\mu$m)

[5] Quenched $Sm_2Fe_{17}N_3$ powder (average particle size=2 $\mu$m)

[6] Isotropic $Nd_{13}Fe_{69}Co_{11}B_6Ga_1$ powder by the HDDR method (average particle size=28 $\mu$m)

[7] Nanocrystalline $Nd_{5.5}Fe_{66}B_{18.5}Co_5Cr_5$ powder (average particle diameter=15 $\mu$m)

Thermoplastic Resin:

A. Polyamide (Nylon12) (beat deformation temperature: 145° C., melting point 175° C.)

B. Crystalline Liquid Polymer (heat deformation temperature: 180° C., melting point 280° C.)

C. Polyphenylene sulfide (PPS) (heat deformation temperature: 260° C., melting point 280° C.)

Fluorine-based Resin Powder:

a. Tetrafluoroethylene Resin (PTFE)

b. Tetrafluoroethylene-ethylene copolymer (ETFE)

Lubricants:

a. Metallic Soap (Zinc Stearate)

b. Silicone Oil

TABLE 1

| | Composition [vol %] | | Composition [vol %] |
|---|---|---|---|
| Embodiment 1 | Magnetic powder [1]: 80.5<br>Resin A: 12.3<br>Fluorine-based resin a: 1.2<br>Antioxidant: 6.0 | Embodiment 12 | Magnetic powder [4]: 75.0<br>Resin C: 22.9<br>Fluorine-based resin b: 2.1 |
| Embodiment 2 | Magnetic powder [2]: 81.0<br>Resin A: 13.7<br>Fluorine-based resin a: 1.3<br>Antioxidant: 4.0 | Embodiment 13 | Magnetic powder [2]: 70.0<br>Resin B: 21.6<br>Fluorine-based resin b: 1.9<br>Antioxidant: 6.5 |
| Embodiment 3 | Magnetic powder [4]: 83.5<br>Resin A: 14.5<br>Fluorine-based resin b: 2.0 | Embodiment 14 | Magnetic powder [4]: 70.0<br>Resin A: 21.7<br>Fluorine-based resin a: 1.0<br>Fluorine-based resin b: 0.8<br>Auxiliary lubricant: 1.0<br>Antioxidant: 5.5 |
| Embodiment 4 | Magnetic powder [6]: 82.0<br>Resin A: 12.0<br>Fluorine-based resin a: 1.0<br>Auxiliary lubricant: 0.3<br>Antioxidant: 4.7 | Embodiment 15 | Magnetic powder [4]: 40.0<br>Magnetic powder [5]: 36.0<br>Resin A: 17.0<br>Fluorine-based resin b: 2.2<br>Auxiliary lubricant: 0.8<br>Antioxidant: 4.0 |
| Embodiment 5 | Magnetic powder [4]: 82.0<br>Resin C: 12.7<br>Fluorine-based resin a: 1.3<br>Antioxidant: 4.0 | Embodiment 16 | Magnetic powder [1]: 78.1 |

TABLE 1-continued

| | Composition [vol %] | | Composition [vol %] |
|---|---|---|---|
| Embodiment 6 | Magnetic powder [4]: 81.5<br>Resin B: 16.8<br>Fluorine-based resin b: 1.7 | | Resin B: 21.5<br>Fluorine-based resin b: 0.4 |
| Embodiment 7 | Magnetic powder [1]: 40.0<br>Magnetic powder [7]: 42.0<br>Resin A: 11.9<br>Fluorine-based resin a: 1.1<br>Auxiliary lubricant: 0.5<br>Antioxidant: 4.5 | Embodiment 17 | Magnetic powder [1]: 79.0<br>Resin B: 17.5<br>Fluorine-based resin b: 3.5 |
| Embodiment 8 | Magnetic powder [4]: 82.0<br>Resin A: 12.1<br>Fluorine-based resin b: 1.2<br>Antioxidant: 4.7 | Comparative Example 1 | Magnetic powder [7]: 84.0<br>Resin C: 14.0<br>Antioxidant: 2.0 |
| Embodiment 9 | Magnetic powder [1]: 82.5<br>Resin B: 10.1<br>Fluorine-based resin b: 0.9<br>Antioxidant: 6.5 | Comparative Example 2 | Magnetic powder [1]: 81.0<br>Resin A: 11.7<br>Lubricant a: 1.4<br>Auxiliary lubricant: 0.4<br>Antioxidant: 5.5 |
| Embodiment 10 | Magnetic powder [3]: 80.0<br>Resin B: 14.0<br>Fluorine-based resin b: 1.3<br>Antioxidant: 4.7 | Comparative Example 3 | Magnetic powder [4]: 71.5<br>Resin A: 21.2<br>Lubricant b: 1.8<br>Antioxidant: 5.5 |
| Embodiment 11 | Magnetic powder [4]: 25.0<br>Magnetic powder [5]: 23.0<br>Magnetic powder [6]: 24.0<br>Resin C: 20.7<br>Fluorine-based resin a: 1.8<br>Antioxidant: 5.5 | Comparative Example 4 | Magnetic powder [1]: 44.0<br>Resin A: 55.0 |
| | | Comparative Example 5 | Magnetic powder [1]: 88.0<br>Epoxy Resin: 12.0 |

The inclusion ratio [vol %] of fluorine-based resin powder to thermoplastic resin (binding resin) in the composition for rare earth bonded magnet use is shown in the following Table 2.

TABLE 2

| | Ratio of Fluorine-based Resin Powder to Binding Resin [vol %] | Average Particle Diameter of the Fluorine-based Resin Powder [μm] |
|---|---|---|
| Embodiment 1 | 9.8 | 2.0 |
| Embodiment 2 | 9.5 | 5.3 |
| Embodiment 3 | 13.8 | 3.6 |
| Embodiment 4 | 8.3 | 30.0 |
| Embodiment 5 | 10.2 | 6.8 |
| Embodiment 6 | 10.1 | 3.7 |
| Embodiment 7 | 9.2 | 4.8 |
| Embodiment 8 | 9.9 | 2.6 |
| Embodiment 9 | 8.9 | 5.5 |
| Embodiment 10 | 9.3 | 17.4 |
| Embodiment 11 | 8.7 | 10.1 |
| Embodiment 12 | 9.2 | 8.6 |
| Embodiment 13 | 8.8 | 25.3 |
| Embodiment 14 | 8.3 | 20.9 |
| Embodiment 15 | 12.9 | 12.5 |
| Embodiment 16 | 1.9 | 8.5 |
| Embodiment 17 | 20.0 | 4.6 |

TABLE 2-continued

| | Ratio of Fluorine-based Resin Powder to Binding Resin [vol %] | Average Particle Diameter of the Fluorine-based Resin Powder [μm] |
|---|---|---|
| Comparative Example 1 | — | — |
| Comparative Example 2 | — | — |
| Comparative Example 3 | — | — |
| Comparative Example 4 | — | — |
| Comparative Example 5 | — | — |

Next, each mixture of a composition shown in Table 1 is sufficiently kneaded using a screw system kneading machine (apparatus a) or a kneader (apparatus b), and a composition (compound) for a rare earth bonded magnet use is obtained. The kneading conditions at this time are shown in Tables 3 and 4. Moreover, as for the densities of the compounds, both a theoretical density of 85% or more and magnetic powder of 70% or more is attained.

Next, this compound is used, there is molding in a magnetic field or nonmagnetic field, and a rare earth bonded magnet is obtained with materials removed. The molding methods and molding conditions at this time are shown in Tables 3 and 4.

TABLE 3

| | Kneading Conditions | | | Molding Conditions | | | | |
|---|---|---|---|---|---|---|---|---|
| | | | | | Mold Temperature [° C.] | | | |
| | Apparatus | Kneading Temperature [° C.] | Kneading Time [min] | Molding Method | High temperature region | Low temperature region | Molding Pressure [kgf/mm$^2$] | Alignment Magnetic Field [kOe] |
| Embodiment 1 | a | 150–250 | 10–20 | Warm molding | 230 | 100 | 15 | 0 |

TABLE 3-continued

| | Kneading Conditions | | | Molding Conditions | | | | |
|---|---|---|---|---|---|---|---|---|
| | | | | | Mold Temperature [° C.] | | | |
| | Apparatus | Kneading Temperature [° C.] | Kneading Time [min] | Molding Method | High temperature region | Low temperature region | Molding Pressure [kgf/mm$^2$] | Alignment Magnetic Field [kOe] |
| Embodiment 2 | a | 150–250 | 10–20 | Warm molding | 230 | 100 | 15 | 0 |
| Embodiment 3 | a | 150–250 | 10–20 | Warm molding | 230 | 100 | 20 | 0 |
| Embodiment 4 | b | 230 | 40 | Warm molding | 230 | 100 | 20 | 20 |
| Embodiment 5 | b | 350 | 30 | Warm molding | 320 | 200 | 20 | 15 |
| Embodiment 6 | a | 280–360 | 15–30 | Extrusion molding | 320 | 230 | 5 | 0 |
| Embodiment 7 | a | 150–250 | 10–20 | Extrusion molding | 250 | 150 | 4 | 0 |
| Embodiment 8 | a | 150–250 | 10–20 | Extrusion molding | 250 | 150 | 4 | 15 |
| Embodiment 9 | b | 320 | 30 | Warm molding | 320 | 200 | 5 | 0 |
| Embodiment 10 | b | 320 | 40 | Extrusion molding | 320 | 200 | 5 | 0 |

TABLE 4

| | Kneading Conditions | | | Molding Conditions | | | | |
|---|---|---|---|---|---|---|---|---|
| | | | | | Mold Temperature [° C.] | | | |
| | Apparatus | Kneading Temperature [° C.] | Kneading Time [min] | Molding Method | High temperature region | Low temperature region | Molding Pressure [kgf/mm$^2$] | Alignment Magnetic Field [kOe] |
| Embodiment 11 | a | 260–360 | 15–30 | Injection molding | 350 | 200 | 20 | 15 |
| Embodiment 12 | a | 260–360 | 15–30 | Injection molding | 350 | 200 | 20 | 15 |
| Embodiment 13 | a | 280–360 | 15–30 | Injection molding | 350 | 200 | 20 | 0 |
| Embodiment 14 | b | 230 | 20 | Injection molding | 230 | 120 | 20 | 15 |
| Embodiment 15 | b | 230 | 50 | Injection molding | 230 | 120 | 20 | 15 |
| Embodiment 16 | a | 230–320 | 15–30 | Extrusion molding | 320 | 230 | 7 | 0 |
| Embodiment 17 | a | 230–320 | 15–30 | Extrusion molding | 320 | 230 | 4 | 0 |
| Comparative Example 1 | b | 320 | 40 | Warm molding | 320 | 200 | 55 | 15 |
| Comparative Example 2 | a | 150–250 | 10–20 | Extrusion molding | 250 | 150 | 10 | 0 |
| Comparative Example 3 | a | 150–250 | 10–20 | Injection molding | 280 | 120 | 40 | 15 |
| Comparative Example 4 | b | 150–250 | 10–20 | Injection molding | 280 | 120 | 10 | 0 |
| Comparative Example 5 | b | Room temperature | 60 | Compaction molding | Room temperature | Room temperature | 80 | 0 |

Note: The material temperature of extrusion molding is the beating temperature
The material temperature of injection molding shows the temperature during injection.

The forms, measurements, composition, appearance (visual observation), mechanical strength, the mold release, magnetic properties and the like are shown in Tables 5 to 8.

The mechanical strength of the magnets is evaluated by a shearing and punching method which uses test sheets, that are specially molded in a nonmagnetic field with the conditions shown in Tables 3 and 4, which test sheets have outer diameters of 15 mm and heights of 3 mm.

In addition, an evaluation of the mold release is performed by the following respective methods for each molding method.

In the case of a compaction molding method, an evaluation is performed by a pulling pressure when the molded product is pulled out.

When the pulling pressure exceeds 50% of the molding pressure it is "not good", but when it is 50% or below it is "good".

In the case of an extrusion molding method, when the extrusion speed during the molding does not satisfy 4 mm/s it is "not good", but when it is 4 mm/s or above it is "good".

In the case of an injection molding method, when a mold release is performed with the taper amount made to be 5/100 mm in the direction that a magnet is pulled out of a metal mold, if mold release is not possible it is "not good", but if mold release is possible it is "good".

Comparative Example 5

Magnetic powder and a binding resin made from epoxy resin (thermosetting resin) are mixed in a ratio shown in Table 1. This mixture is kneaded at room temperature, compaction molding (press molding) is performed from the obtained compound under conditions shown in Table 4, resin hardening is brought about by heat treatment of the molding for one hour at 150° C., and a rare earth bonded magnet is obtained.

The form, measurements, composition, appearance (visual observation), mechanical strength, the mold release, magnetic properties and the like of the obtained molding are shown in Table 8.

Furthermore, the same evaluation as described above is performed with respect to the mechanical strength.

TABLE 5

| | Magnet form | Magnet measurements [mm] | Magnet composition [vol %] | Magnetic energy product (BH)max [MGOe] | Density ρ [g/cm$^3$] | Void ratio (%) | Looks | Mechanical strength (kg/mm$^2$) | Mold release |
|---|---|---|---|---|---|---|---|---|---|
| Embod. 1 | Cylindrical | Outer diam.: 18.0<br>Thickness: 1.0<br>Height: 5.5 | Magnetic powder [1]: 81.1<br>Resin A: 12.4<br>Fluorine-based resin powder a: 1.2<br>Antioxidant: 4.7 | 10.8 | 6.33 | 0.6 | Good | 8.01 | Good |
| Embod. 2 | Cylindrical | Outer diam.: 20.5<br>Thickness: 1.2<br>Height: 3.0 | Magnetic particles [2]: 81.3<br>Resin A: 13.8<br>Fluorine-based resin powder a: 1.3<br>Antioxidant: 3.0 | 9.0 | 6.34 | 0.6 | Good | 8.13 | Good |
| Embod. 3 | Cylindrical | Outer diam.: 24.0<br>Thickness: 2.0<br>Height: 5.2 | Magnetic powder [4]: 82.1<br>Resin A: 14.3<br>Fluorine-based resin powder b: 2.0 | 12.0 | 7.17 | 1.6 | Good | 7.89 | Good |
| Embod. 4 | Cylindrical | Outer diam.: 32.0<br>Thickness: 1.8<br>Height: 7.0 | Magnetic powder [6:] 82.0<br>Resin A: 12.0<br>Fluorine-based resin powder a: 1.0<br>Aux. lubricant: 0.1<br>Antioxidant: 4.0 | 20.1 | 6.38 | 0.9 | Good | 7.80 | Good |
| Embod. 5 | Cylindrical | Outer diam.: 12.8<br>Thickness: 1.2<br>Height: 3.0 | Magnetic powder [4]: 81.5<br>Resin C: 12.6<br>Fluorine-based resin powder a: 1.3<br>Antioxidant: 2.8 | 17.5 | 7.16 | 1.8 | Good | 8.33 | Good |

TABLE 6

| | Magnet form | Magnet measurements [mm] | Magnet composition [vol %] | Magnetic energy product (BH)max [MGOe] | Density ρ [g/cm$^3$] | Void ratio (%) | Looks | Mechanical strength (kgf/mm$^2$) | Mold release |
|---|---|---|---|---|---|---|---|---|---|
| Embod. 6 | Rectangular Parallel opiped | Width: 20.0<br>Height: 1.4 | Magnetic powder [4]: 80.7<br>Resin B: 16.6<br>Fluorine-based resin powder b: 1.7 | 8.4 | 7.13 | 1.0 | Good | 8.15 | Good |
| Embod. 7 | Cylindrical | Outer diam.: 55.0<br>Thickness: 2.5 | Magnetic powder [1]: 40.4<br>Magnetic powder [7]: 42.4<br>Resin A: 12.0<br>Fluorine-based resin powder a: 1.1<br>Aux. lubricant: 0.1<br>Antioxidant: 3.1 | 10.7 | 6.43 | 0.9 | Good | 7.77 | Good |

TABLE 6-continued

| | Magnet form | Magnet measurements [mm] | Magnet composition [vol %] | Magnetic energy product (BH)max [MGOe] | Density ρ [g/cm$^3$] | Void ratio (%) | Looks | Mechanical strength (kgf/mm$^2$) | Mold release |
|---|---|---|---|---|---|---|---|---|---|
| Embod. 8 | Cylindrical | Outer diam.: 12.5<br>Thickness: 1.5 | Magnetic powder [4]: 81.9<br>Resin A: 12.1<br>Fluorine-based resin powder b: 1.2<br>Antioxidant: 3.7 | 15.2 | 7.15 | 1.1 | Good | 7.88 | Good |
| Embod. 9 | Cylindrical | Outer diam.: 40.0<br>Thickness: 1.2<br>Height: 5.5 | Magnetic powder [1]: 83.8<br>Resin B: 10.3<br>Fluorine-based resin powder b: 0.9<br>Antioxidant: 3.4 | 10.7 | 6.53 | 1.6 | Good | 8.21 | Good |
| Embod. 10 | Bent form | Outer diam.: 5.5<br>Inner diam.: 4.4<br>Angle: 120° | Magnetic powder [3]: 80.9<br>Resin B: 14.2<br>Fluorine-based resin powder b: 1.3<br>Antioxidant: 3.0 | 8.4 | 6.37 | 0.6 | Good | 8.43 | Good |

TABLE 7

| | Magnet form | Magnet measurements [mm] | Magnet composition [vol %] | Magnetic energy product (BH)max [MGOe] | Density ρ [g/cm$^3$] | Void ratio (%) | Looks | Mechanical strength (kgf/mm$^2$) | Mold release |
|---|---|---|---|---|---|---|---|---|---|
| Embod. 11 | Columnar | Outer diam.: 10.0<br>Height: 8.0 | Magnetic powder [4]: 25.0<br>Magnetic powder [5]: 23.0<br>Magnetic powder [6]: 24.0<br>Resin C: 20.7<br>Fluorine-based resin powder a: 1.8<br>Antioxidant: 4.5 | 13.5 | 6.06 | 1.0 | Good | 8.54 | Good |
| Embod. 12 | Cube | One side: 12.0 | Magnetic powder [4]: 74.8<br>Resin C: 22.8<br>Fluorine-based resin powder b: 2.0 | 13.1 | 6.71 | 0.4 | Good | 7.75 | Good |
| Embod. 13 | Cylindrical | Outer diam.: 32.8<br>Thickness: 1.2<br>Height: 2.0 | Magnetic powder [2]: 70.7<br>Resin B: 21.8<br>Fluorine-based resin powder b: 1.9<br>Antioxidant: 5.2 | 4.5 | 5.76 | 0.4 | Good | 7.46 | Good |
| Embod. 14 | Cylindrical | Outer diam.: 22.0<br>Thickness: 1.1<br>Height: 5.0 | Magnetic powder [4]: 70.9<br>Resin A: 22.0<br>Fluorine based resin powder a: 1.0<br>Fluorine-based resin powder b: 0.8<br>Aux. lubricant: 0.1<br>Antioxidant: 5.0 | 10.1 | 6.35 | 0.2 | Good | 7.34 | Good |
| Embod. 15 | Cylindrical | Outer diam.: 22.0<br>Thickness: 1.8<br>Height: 3.0 | Magnetic powder [4]: 40.2<br>Magnetic powder [5]: 36.2<br>Resin A: 17.1<br>Fluorine-based resin powder b: 2.2<br>Aux. lubricant: 0.2<br>Antioxidant: 3.3 | 14.0 | 6.43 | 0.8 | Good | 7.47 | Good |

TABLE 8

| | Magnet form | Magnet measurements [mm] | Magnet composition [vol %] | Magnetic energy product (BH)max [MGOe] | Density ρ [g/cm³] | Void ratio (%) | Looks | Mechanical strength (kg/mm²) | Mold release |
|---|---|---|---|---|---|---|---|---|---|
| Embod. 16 | Cylindrical | Outer diam.: 18.0 Thickness: 2.0 | Magnetic powder [1]: 78.1 Resin B: 21.5 Fluorine-based resin powder b: 0.4 | 10.1 | 6.21 | 0 | Good | 8.12 | Good |
| Embod. 17 | Cylindrical | Outer diam.: 18.0 Thickness: 1.5 | Magnetic powder [1]: 78.8 Resin B: 17.5 Fluorine-based resin powder b: 3.5 | 10.5 | 6.28 | 0.2 | Good | 8.01 | Good |
| Comp. Example 1 | Columnar | Outer diam.: 30.0 Height: 1.5 | Magnetic powder [7]: 82.6 Resin C: 13.7 Antioxidant: 0.9 | 11.3 | 6.43 | 2.8 | Not good (surface coarse) | 6.88 | Not good |
| Comp. Example 2 | Cylindrical | Outer diam.: 25.0 Thickness: 1.2 | Magnetic powder [1]: 81.6 Resin A: 11.8 Lubricant a: 0.4 Aux. lubricant: 0.1 Antioxidant: 3.3 | 10.3 | 6.32 | 2.8 | Not good (surface coarse) | 5.77 | Not good |
| Comp. Example 3 | Cylindrical | Outer diam.: 13.0 Thickness: 1.2 Height: 5.5 | Magnetic powder [4]: 70.6 Resin A: 20.9 Lubricant b: 1.8 Antioxidant: 4.1 | 11.5 | 6.28 | 2.6 | Not good (discharge) | 6.35 | Not good |
| Comp. Example 4 | Columnar | Outer diam.: 12.0 Height: 10.0 | Magnetic powder [1]: 44.0 Resin A: 56.0 | 4.0 | 3.89 | 0.1 | Good | 7.11 | Good |
| Comp. Example 5 | Cylindrical | Outer diam.: Thickness: not measured Height: | Magnetic powder [1]: not measured Epoxy resin: not measured | Not measured as because molding is not possible | | | | | |

As for the rare earth bonded magnets of embodiments 1 to 17, it was confirmed that the magnetic properties (maximum magnetic energy product) are superior along with the molding characteristics given a favorable mold release, and also that all of the void ratios are low and the mechanical strengths are high, as shown in each of the tables above. Furthermore, all of these rare earth bonded magnets have stable forms, and have high measurement accuracy.

In contrast, since the rare earth bonded magnet of comparative example 1 does not have fluorine-based resin powder added therein, the mold release characteristic is not good, the molding characteristics are inferior, there is also low mechanical strength, and the magnetic properties are further inferior.

In comparative example 3, the phenomena of silicone oil discharge was also observed in the molded product, since silicone oil was used as the lubricant.

In addition, with comparative example 4, since a composition for rare earth bonded magnet usage was used in which fluorine-based resin powder was not included and the additional amount of thermoplastic resin was also too much, the molded product (magnet) was inferior in magnetic properties and mechanical strength.

Moreover, in comparative example 5, an epoxy resin (thermosetting resin) is used as the binding resin, and molding was not possible because this additional amount was too little.

As described above, based on the present invention, a rare earth bonded magnet can be obtained in which the void ratio is low, the molding characteristics and mechanical properties are superior, and the magnetic properties are superior. In particular, the mold release is especially improved when there is material removal due to the lubrication of the of fluorine-based resin powder. Because of this, the so-called mold dependence or such is prevented, and the measurement accuracy is high.

In addition, when there is manufacturing from compaction molding, a magnet can be obtained with these sort of superior characteristics under a low pressure, which is profitable with respect to manufacturing. In addition, there is a contribution to improving molding and the fluidity of materials in extrusion molding. There is also a contribution to molding and the fluidity of materials when there is injection molding.

INDUSTRIAL APPLICATION POSSIBILITY

Rare earth bonded magnets of the present invention are suited for use in stepping motors, spindle motors or the like which are used in information instruments.

What is claimed is:

1. A composition for a rare earth bonded magnet comprising rare earth magnetic powder and binding resin containing thermoplastic resin; wherein the composition comprises fluorine-based resin powder with a particle size of 2–30 μm and 2–12 vol % of an antioxidant.

2. The composition for a rare earth bonded magnet of claim 1, wherein a content of the fluorine-based resin powder is less than 20 vol % relative to the thermoplastic resin.

3. A composition for a rare earth bonded magnet prepared by kneading a mixture of rare earth magnetic powder, binding resin containing thermoplastic resin, an antioxidant and a lubricant; wherein fluorine-based resin powder with a particle size of 2–30 μm is contained as the lubricant and the content of the antioxidant is 2–12%.

4. The composition for a rare earth bonded magnet of claim 3, wherein a content of the fluorine-based resin powder is less than 20 vol % relative to the thermoplastic resin.

5. The composition for a rare earth bonded magnet of claim 3, wherein an average particle diameter of the fluorine-based resin powder is 2–30 μm.

6. A rare earth bonded magnet prepared by bonding rare earth magnetic powder with binding resin containing thermoplastic resin; wherein the magnet contains fluorine-based resin powder with a particle size of 2–30 μm;

said rare earth bonded magnet has a rare earth magnetic powder content of 68–76 vol % when prepared by an injection molding method; and said rare earth bonded magnet has a rare earth magnetic powder content of 78.1–83 vol % when prepared by an extrusion molding method.

7. The rare earth bonded magnet of claim 6, wherein a content of the fluorine-based resin powder is less than 20 vol % relative to the thermoplastic resin.

8. The rare earth bonded magnet of claim 6, wherein the fluorine-based resin powder comprises at least one resin selected from the group consisting of tetrafluoroethylene, tetrafluoroethylene-perfluoroalkoxyethylene copolymer, tetrafluoroethylene-propylene hexafluoride copolymer, tetrafluoroethylene-propylene hexafluoride-perfluoroalkoxyethylene copolymer, tetrafluoroethylene-ethylene copolymer, ethylene chloride trifluoride copolymer, ethylene chloride trifluoride-ethylene copolymer, vinylidene fluoride, and polyvinyl fluoride.

9. The rare earth bonded magnet of claim 6, wherein the rare earth magnetic powder comprises rare earth elements mainly containing Sm and transition metals mainly containing Co.

10. The rare earth bonded magnet of claim 6, wherein the rare earth magnetic powder comprises R (wherein R is at least one rare earth element among rare earth elements containing Y), transition metals mainly containing Fe, and B.

11. The rare earth bonded magnet of claim 6, wherein the rare earth magnetic powder comprises rare earth elements mainly containing Sm, transition metals mainly containing Fe, and interstitial elements mainly containing N.

12. The rare earth bonded magnet of claim 6, wherein the rare earth magnetic powder is composed of at least two rare earth magnetic powders selected from rare earth magnetic powders comprising Sm and Co and rare earth magnetic powders comprising Sm, Fe and N.

13. The rare earth bonded magnet of claim 6, wherein a product of isotropic magnetic energy ($(BH)_{max}$) is more than 4.5 MGOe.

14. The rare earth bonded magnet of claim 6, wherein a product of anisotropic magnetic energy ($(BH)_{max}$) is more than 10 MGOe.

15. The rare earth bonded magnet of claim 6, wherein the void ratio is below 2 vol %.

16. A method for manufacturing a rare earth bonded magnet comprising the steps of:

preparing a composition for a rare earth bonded magnet containing rare earth magnetic powder, binding resin including thermoplastic resin, and fluorine-based resin powder with a particle size of 2–30 μm;

kneading the composition above the softening temperature of the binding resin; and molding the composition for a rare earth bonded magnet into a shape.

17. The method of claim 16, wherein the composition for a rare earth bonded magnet contains the fluorine-based resin powder at less than 20 vol % relative to the thermoplastic resin.

18. The method of claim 16, wherein the composition for a rare earth bonded magnet contains an antioxidant.

19. The method of claim 16, wherein the composition for a rare earth bonded magnet contains the antioxidant at 2–12 vol %.

20. The method of claim 16, wherein molding is accomplished by an injection molding method.

21. The method of claim 16, wherein molding is accomplished by an extrusion molding method.

22. A rare earth bonded magnet comprising a rare earth magnetic powder, thermoplastic resin, and fluorine-based resin powder having a particle size of 2–30 μm produced by extrusion molding or injection molding.

23. The rare earth bonded magnet of claim 22, wherein the rare earth magnetic powder comprises rare earth elements mainly containing Sm and transition metals mainly containing Co.

24. The rare earth bonded magnet of claim 22, wherein the rare earth magnetic powder comprises R (wherein R is at least one rare earth element among rare earth elements containing Nd), transition metals mainly containing Fe, and B.

25. The rare earth bonded magnet of claim 22, wherein the rare earth magnetic powder comprises rare earth elements mainly containing Sm, transition metals mainly containing Fe, and interstitial elements mainly containing N.

26. The rare earth bonded magnet of claim 22, wherein the rare earth magnetic powder is composed of at least two rare earth magnetic powders selected from rare earth magnetic powders comprising Sm and Co and rare earth magnetic powders comprising Sm, Fe and N.

* * * * *

UNITED STATES PATENT AND TRADEMARK OFFICE

CERTIFICATE OF CORRECTION

PATENT NO. : 6,387,293 B1
DATED : May 14, 2002
INVENTOR(S) : Koji Akioka et al.

It is certified that error appears in the above-identified patent and that said Letters Patent is hereby corrected as shown below:

Column 4,
Line 43, "Th" should be -- Tb --.

Column 12,
Line 32, "beat" should be -- heat --.

Column 15,
Line 57, "beating" should be -- heating --.

Column 22,
Line 39, delete 2nd occurrence of "of".

Column 24,
Line 24, "claim 16" should be -- claim 18 --.

Signed and Sealed this

Fifth Day of November, 2002

*Attest:*

*Attesting Officer*

JAMES E. ROGAN
*Director of the United States Patent and Trademark Office*